United States Patent [19]

Umezaki et al.

[11] 4,262,054

[45] Apr. 14, 1981

[54] MAGNETIC BUBBLE MEMORY DEVICE

[75] Inventors: Hiroshi Umezaki, Hachioji; Hideki Nishida, Tokyo; Hirozi Yamada, Hachioji; Yutaka Sugita, Tokorozawa; Katsuhiro Kaneko, Sayama; Nagatugu Koiso, Tama, all of Japan; Masatake Takahashi, deceased, late of Hachioji, Japan, by Keiko Takahashi, administratrix

[73] Assignee: Hitachi, Ltd., Tokyo, Japan

[21] Appl. No.: 63,446

[22] Filed: Aug. 3, 1979

[51] Int. Cl.[3] ..... H01F 10/00

[52] U.S. Cl. ..... 428/336; 428/339; 428/412; 428/416; 428/458; 428/469; 428/524; 428/900; 428/473.5; 428/692

[58] Field of Search ..... 427/131; 428/900, 336, 428/339, 412, 416, 458, 469, 474, 524, 539

[56] References Cited

U.S. PATENT DOCUMENTS 4,013,803 3/1977 Josephs ..... 427/131 X

*Primary Examiner*—Bernard D. Pianalto

*Attorney, Agent, or Firm*—Craig and Antonelli

[57] ABSTRACT

A magnetic bubble memory device is disclosed in which a hardened film made of a heat-resisting highly-polymerized organic resin and having a predetermined thickness is employed for an insulating film interposed between a conductor pattern and a soft magnetic material pattern. In a conventional magnetic bubble memory device in which the above-mentioned insulating film is made of $SiO_2$, an abrupt step is produced in the soft magnetic material pattern due to the existence of the conductor pattern beneath a portion of the soft magnetic material pattern, and the margin of bias magnetic field is thereby lowered. According to the present invention, the step is reduced and smoothed, and thus the lowering of the margin can be prevented.

12 Claims, 11 Drawing Figures

MAGNETIC BUBBLE MEMORY DEVICE

The present invention relates to a magnetic bubble memroy device, and more particularly to a magnetic bubble memory device in which the step in a soft magnetic material pattern which is caused by an underlying conductor pattern, is smoothed to gain a large bias magnetic field margin for transferring magnetic bubbles.

The conventional magnetic bubble memory device has, in general, such a structure as shown in FIG. 1 of the accompanying drawings. Referring to FIG. 1, there are successively stacked on a magnetic film 1 which can maintain therein magnetic bubbles, a first insulating film 2, a conductor pattern 3 formed of, for example, a gold film, a second insulating film 4, a soft magnetic material pattern 5 which is usually formed of a permalloy film and is used to transfer or detect the magnetic bubbles, and a protecting film (not shown). The magnetic film 1 is formed on a non-magnetic garnet substrate which is not shown in FIG. 1 since it has no direct connection with the present invention.

In such a conventional device, as is apparent from FIG. 1, the surface of the second insulating film 4 is not flat due to the existence of the conductor pattern 3, and therefore a step is also produced in the soft magnetic material pattern 5 when a part of the pattern 5 overlaps the couductor pattern 3. When such a steep step as shown in FIG. 1 exists in the soft magnetic material pattern 5, an undesired magnetic pole is generated, and therefore the margin of a bias magnetic field for transferring magnetic bubbles is considerably decreased. The above trouble due to the step in the soft magnetic material pattern 5 becomes remarkable as the diameter of magnetic bubbles is smaller. Accordingly, in order to fabricate a magnetic bubble memory device having a high packing density, it is required to make the soft magnetic material pattern flat, that is, to eliminate the step in the soft magnetic material pattern. Recently, the conductor pattern has been formed usually through ion milling, to obtain a fine pattern. In this case, the inclination of side walls of the conductor pattern becomes equal to about 80 degrees, that is, the side walls are nearly vertical, and therefore the above-mentioned step as well as the adverse effect due to the step become more remarkable.

In order to reduce the step caused by the conductor pattern and to prevent the lowering of the bias field margin, several methods have hitherto been proposed.

For example, an article entitled "Planar Processing for Magnetic Bubble Devices" by D. K. Rose, IEEE Transactions on Magnetics, Vol. MAG-12, No. 6, November, 1976, pp. 618 to 621, has proposed a method for making the thickness of a conductor pattern equal to that of an oxide film, in which an Al-Cu film is first provided on the entire surface, and the film in a region where no conductor pattern is needed, is reduced in thickness and then anodized to form the oxide film. Further, an article entitled "Fabrication of Large Bubble Circuits", by J. P. Reekstin & R. Kowalchuk, IEEE Transactions on Magnetics, Vol. MAG-9, No. 3, September 1973, pp. 485 to 488, has proposed a resist lift-off method in which an $SiO_2$ film is provided on the entire surface with a photoresist film on a conductor pattern being left, and then the $SiO_2$ film on the conductor pattern is removed together with the photoresist film.

In these conventional methods, however, it is difficult to completely anodize the Al-Cu film or to remove the photoresist film in a satisfactory manner. Therefore, it has been hard to fabricate a magnetic bubble memory device having a favorable planar structure. Further, no prior art devices or publications show or disclose the feature of the present invention that the step appearing in a magnetic bubble memory device can be reduced by employing a heat-resisting highly-polymerized resin.

Accordingly, an object of the present invention is to provide a magnetic bubble memory device which can reduce the step in the soft magnetic material pattern caused by the underlying conductor pattern to make large the margin of the bias magnetic field for transferring magnetic bubbles, and therefore can solve the above-mentioned problem encountered with the conventional device.

In order to attain the above and other objects, according to the present invention, a hardened film (hereinafter referred to as a resin film) made of heat-resisting highly-polymerized organic resin and having a predetermined thickness is used for at least the second insulating film of the first and second insulating films.

The foregoing object and other objects as well as the characteristic features of the invention will become more apparent by the following description taken in conjuction with the accompanying drawings in which.

Figure 2:
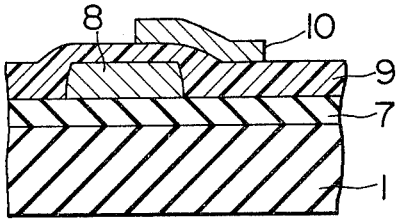
FIG. 2 is a sectional view showing a part of an embodiment of a magnetic bubble memory device according to the present invention.

Referring to FIG. 2 which shows an embodiment of a magnetic bubble memory device according to the present invention, an $SiO_2$ film 7 having a thickness of 200 nm is provided, as the first insulating film, on a garnet film 1 which can maintain therein magnetic bubbles. A hardened film 9 having a thickness of 300 nm and made of polyimide resin such as polyimideisoindroquinazolindion (hereinafter referred to as PII) is interposed, as the second insulating film, between a conductor pattern 8 made of gold and a soft magnetic material pattern 10 made of permalloy. Incidentally, an actual magnetic bubble memory device further includes a non-magnetic garnet substrate on which the garnet film 1 is epitaxially grown, a film for suppressing hard bubbles and a protecting film. Since the substrate and films have no direct connection with the present invention, they are omitted in the drawings for brevity's sake.

After the conductor pattern 8 has been formed on the first insulating film 7, a predetermined amount of PII dissolved in a solvent (for example, a mixture of equal parts of N-methyl-2-pyrrolidone and N,N-dimethyl acetamide) is applied on the surface through rotary coating techniques, and then heated to form the PII film 9. The thickness of the PII film thus formed can be controlled by both the concentration of PII and the number of rotations in the coating process. For example, when a PII solution in a concentration of 8% by weight is applied with a rotational frequency of 3,500 rpm, a PII film having a thickness of 300 nm is formed after the heat treatment. When an applied PII film is heated for one hour at a temperature of, for example, 350° C., the PII film hardens, and can have satisfactory characteristics for the insulating film of the magnetic bubble memory device.

Figure 1:
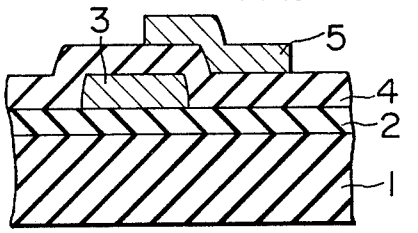
FIG. 1 PRIOR ART
FIG. 1 is a sectional view for explaining a main part of a conventional magnetic bubble memory device.

Since the thickness of the conductor pattern 8 is about 350 nm in ordinary magnetic bubble memory devices, in a case where an $SiO_2$ film having a thickness of 300 nm is applied as the second insulating film in place of the PII film having the same thickness, a steep step is produced as shown in FIG. 1 and the bias field margin is remarkably reduced. In the case where the PII film is used as the second insulating film, since the applied PII is in a liquid phase, it has such property as making its surface smooth. Accordingly, when the PII solution is applied through rotary coating techniques or the like and is left as it is for a predetermined time, the step on the surface of the PII film 9 caused by the underlying conductor pattern 8 is considerably reduced, as shown in FIG. 2, and therefore the step in the soft magnetic material pattern 10 formed on the PII film 9 is also remarkably reduced as compared with the case shown in FIG. 1.

Figure 3:
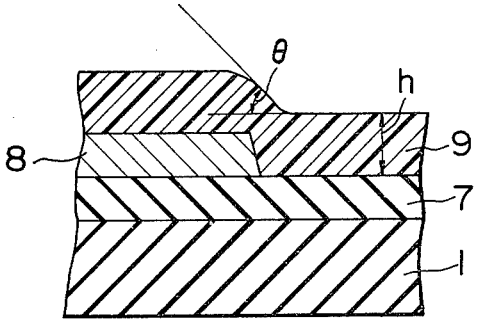
FIG. 3 is a sectional view for explaining the angle of inclination and the thickness of a resin film.
Figure 4:
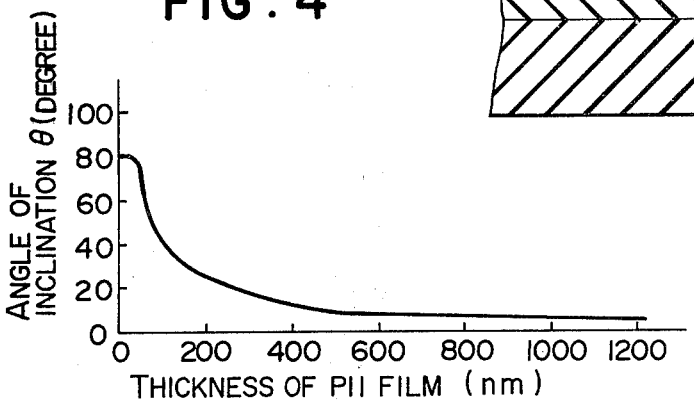
FIG. 4 is a graph showing a relation between the angle of inclination and the thickness of a resin film.
Figure 5:
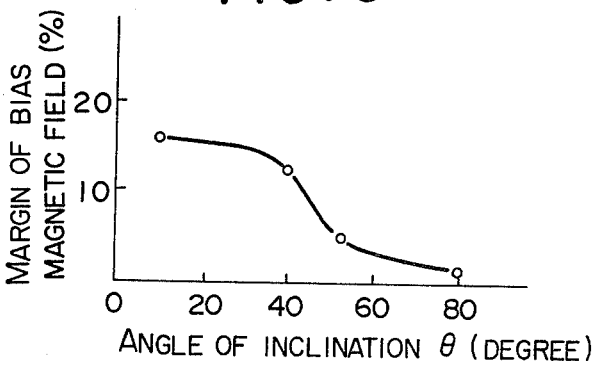
FIG. 5 is a graph showing a relation between the angle of inclination and the bias field margin.

The thickness of the PII film 9 is a matter of great importance in the present invention. When the PII film 9 is too thin, the step cannot be reduced enough. Further, an extremely thin PII film gives rise to the inferior insulation between the conductor pattern 8 and the soft magnetic material pattern 10. On the contrary, when the PII film 9 is too thick, the spacing between the garnet film 1 and the soft magnetic material pattern 10 becomes large, and various troubles are produced with respect to the detection of magnetic bubbles. As is known from the above, in order to prevent the formation of the step without producing such troubles as inferior insulation between the conductor pattern 8 and the soft magnetic material pattern 10 and the unreliable detection of magnetic bubbles, the thickness of the PII film 9 has to be limited within a predetermined range. Referring to FIG. 3, in a structure in which the magnetic film 1 for maintaining therein magnetic bubbles, the first insulating film 7, the conductor pattern 8 and the PII film 9 are successively stacked, it is assumed that a step formed on the PII film 9 has an angle of inclination of $\theta$ and the PII film 9 has a thickness of h. Needless to say, the step becomes low as the angle $\theta$ is smaller, and such a lower angle of $\theta$ is favorable for magnetic bubble memory devices. As shown in FIG. 4, the angle $\theta$ of inclination is small as the thickness h of the PII film is greater. Moreover, the margin of the bias magnetic field is remarkably decreased as the angle $\theta$ of inclination is larger, as shown in FIG. 5. The margin of the bias magnetic field is herein defined as a range of bias magnetic field within which a magnetic bubble memory device can normally operate. In more detail, the expression that the margin of the bias magnetic field is 5% means that the magnetic bubble memory device can normally operate even when the bias magnetic field applied to the device is shifted from the rated value by 5%. As a matter of course, it is desirable to gain a margin as large as possible.

In ordinary magnetic bubble memory devices, the bias magnetic field is established by a permanent magnet. However, since the bias magnetic field is inevitably varied due to temperature variation or the like, a margin of bias magnetic field more than 10% is needed from the practical point of view. As is apparent from FIG. 5, the margin of the bias magnetic field can exceed 10% only in a range of angle of inclination below about 40 degrees, and decreases abruptly when the angle of inclination exceeds 40 degrees. On the other hand, as is seen in FIG. 4, in order to obtain an angle of inclination less than 40 degrees, it is required to make the thickness h of the PII film 9 more than 100 nm. Moreover, when the PII film 9 less than 100 nm in thickness h is employed, the insulation between the conductor pattern and the soft magnetic material pattern becomes inferior. For these reasons, the thickness h of the PII film 9 more than 100 nm is needed.

Since a detector for detecting magnetic bubbles is arranged on the PII film 9, the output of the detector is considerably decreased when the spacing between the detector and the garnet film 1 for maintaining the magnetic bubbles is too large. Therefore, the spacing between the detector and the garnet film is required to be less than a predetermined value. In more detail, the sum of the thickness of the first insulating film 7 and the thickness of the second insulating film 9 has to be less than 1400 nm. When the sum of film thicknesses exceeds 1400 nm, it is very hard to detect magnetic bubbles with high precision.

Further, the first insulating film 7 has to be thick to some extent, in order to relax the stress of the garnet film which maintains therein magnetic bubbles. However, when the film 7 is too thick, the electric current required for the generation of magnetic bubbles is greatly increased. For these reasons, the thickness of the first insulating film 7 has to lie within a range from 100 to 400 nm. This range of film thickness holds in such cases that the first insulating film is made of either one $SiO_2$, $Al_2O_3$, $Si_3N_4$ and heat-resisting highly-polymerized resin.

As is evident from the foregoing, the minimum thickness of the PII film 9 which can be used in the present invention, is 100 nm, and the maximum thickness is 1,000 to 1,300 nm.

Figure 6:
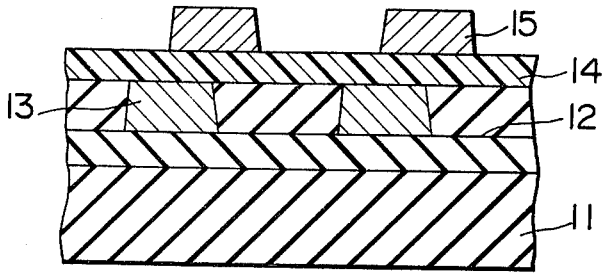
FIG. 6 is a sectional view showing a part of another embodiment of a magnetic bubble memory device according to the present invention.

FIG. 6 shows another embodiment of the present invention. In this embodiment, the upper surface of a first insulating film 12 (an $SiO_2$ film) which is provided on a garnet film 11 capable of maintaining therein magnetic bubbles, is made coincident with the upper surface of a conductor pattern 13 to form a perfectly planar structure. On the upper surface is provided a second insulating layer 14 (a PII film), on which a soft magnetic material pattern 15 is formed. Accordingly, the soft magnetic material pattern has no step. The above structure is formed in the following manner. Firstly, $SiO_2$ is deposited to a thickness corresponding to the bottom of the conductor pattern 13 through chemical vapor deposition or the like, and then the conductor pattern 13 is formed on the deposited $SiO_2$. Next, an $SiO_2$ film is provided on the entire surface, and then the $SiO_2$ film on the conductor pattern 13 is removed through lift-off techniques. However, in the lift-off process, a gap is inevitably formed between the $SiO_2$ film 12 and the side walls of the conductor pattern 13. If the second insulating film 14 is made of $SiO_2$, the gap cannot be completely filled with $SiO_2$. On the contrary, when PII is coated to form the second insulating film 14, the gap is entirely filled with PII in the course of coating, and thus a satisfactory planar structure can be obtained.

Needless to say, various kinds of magnetic garnets such as $(YSmLuCa)_3(FeGe)_5O_{12}$ can be used to form the magnetic film for maintaining therein magnetic bubbles.

The first insulating film can be made of $SiO_2$ which has been generally used, $Si_3N_4$, $Al_2O_3$, or heat-resisting highly-polymerized resin such as PII. However, $Al_2O_3$ is preferred for the reasons that $Al_2O_3$ can adhere well to heat-resisting highly-polymerized resin such as PII which forms the second insulating film, is of high thermal conductivity, and can therefore prevent an excessive temperature rise due to the current flowing through the conductor pattern 13.

The conductor pattern may be made of Al alloys such as Al-Si and Al-Cu alloys or Al, which have been generally used. As the material of the conductor pattern, gold is preferred for the reason that there is little danger of wires being broken due to electromigration and thus a high reliability can be attained. However, gold is poor in adhesion to $SiO_2$ and $Al_2O_3$ which are used to form the first insulating film. Accordingly, it is preferable from the practical point of view to form the conductor pattern of such a double-layer film as including a metal film provided on the first insulating film and made of Mo or the like which adheres well to the first insulating film, and an Au film provided on the above-mentioned metal film.

In the present specification, the embodiment which employs PII as the heat-resisting highly-polymerized resin is explained. However, the heat-resisting highly-polymerized resin usable in the present invention is not limited to PII, but other heat-resisting highly-polymerized resins can produce the same effect as PII. In more detail, magnetic bubble memory devices are heated to a temperature of 150° to 200° C. in the course of fabrication. Therefore, the resin used in the present invention is required to bear such a temperature. Further, in order to reduce the previously-mentioned step, it is required that the viscosity of the resin used is less than 2,000 cps, that the resin does not suffer from any fractures or cracks during a setting period, and that the hardened film of resin has a dielectric strength more than $10^5$ V/cm. The resin which can meet these requirements, is herein referred to as the heat-resisting highly-polymerized resin. There have been hitherto known many resins which can be used in the present invention. In addition to polyimide resin such as PII, for example, epoxy resin, phenol resin, polycarbonate resin, polyamide-imide resin and polybenzimidazole resin can be used. Further, a combination of two or more of these resins can be used. However, the polyimide resin is most preferable from the practical point of view.

The soft magnetic material pattern is formed of a permalloy film or the like, and has various forms such as a T-bar, an I-bar, a chevron and a half disc.

Figure 7A:
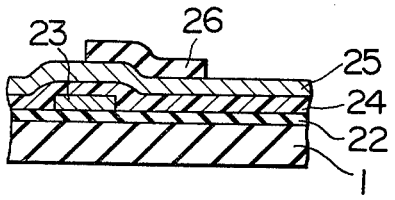
FIGS. 7A to 7E show successive steps of a process for forming a bonding pad according to the present invention.
Figure 7B:
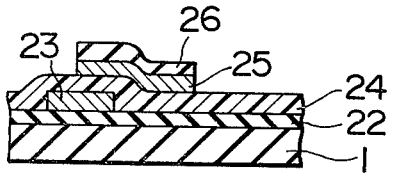
Figure 7C:
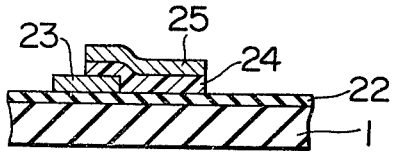
Figure 7D:
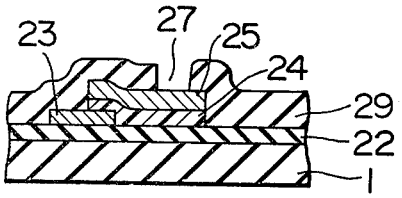
Figure 7E:
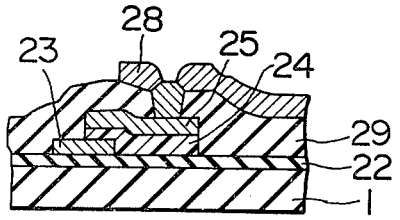

Next, explanation will be made on the formation of a bonding pad according to the present invention. As has been explained hereinbefore, the present invention can provide a magnetic bubble memory device which contains a small step in the soft magnetic material pattern and has a large operating margin. However, when the first insulating film is made of $SiO_2$, the resin used to form the second insulating film does not adhere well to the $SiO_2$ film or the first insulating film. Thus, there is a certain danger of a bonding pad peeling off at the interface between the first and second insulating film. Though such a drawback can be improved by making the first insulating film of $Al_2O_3$, a more favorable bonding pad is obtained with a structure that the resin film is removed beneath the bonding pad. FIGS. 7A to 7E show successive steps of a process for making such a structure. As shown in FIG. 7A, on a garnet film 1 capable of maintaining therein magnetic bubbles are successively formed an $SiO_2$ film 22, a conductor pattern 23 made of an Al-Cu alloy, a PII film 24, a permalloy film 25, and a photoresist pattern 26. As shown in FIG. 7B, an etching operation is conducted using the photoresist pattern as a mask to etch away the exposed portion of the permalloy film 25. Subsequently, the PII film 24 is etched using the permalloy film 25 as a mask for exposure, as shown in FIG. 7C, a part of each of the conductor pattern 23 and the $SiO_2$ film 22. Next, as shown in FIG. 7D, a second $SiO_2$ film 29 is provided on the entire surface, and an opening 27 is formed in the $SiO_2$ film 29 to a depth corresponding to the upper surface of the permalloy film 25. A metal film made of Al or the like is applied and then subjected to photoetching to form a bonding pad 28 having a structure as shown in FIG. 7E. As is seen in FIG. 7E, almost all portions of the bonding pad 28 are devoid of the underlying PII film 24, and moreover the step in the permalloy film 25 is smoothed by the PII film 24. Thus, a magnetic bubble memory device of high reliability can be made with the above structure.

What is claimed is:

1. A magnetic bubble memory device comprising a magnetic film capable of maintaining therein magnetic bubbles, a first insulating film, a conductor pattern, a second insulating film and a soft magnetic material pattern which are stacked on a non-magnetic substrate, wherein at least said second insulating film of said first and second insulating films is a hardened film made of a heat-resisting highly-polymerized organic compound that will withstand a temperature of 150° to 200° C. and that does not exhibit any fractures or cracking during a setting period, and wherein the thickness of said hardened film lies within a range from a minimum value of 100 nm to a maximum value of 1,000 to 1,300 nm.

2. A magnetic bubble memory device according to claim 1, wherein said heat-resisting highly-polymerized organic compound is polyimide resin.

3. A magnetic bubble memory device according to claim 1, wherein said heat-resisting highly-polymerized organic compound is polyimideisoindroquinazolindion.

4. A magnetic bubble memory device according to claim 1, wherein said heat-resisting highly-polymerized organic compound is one selected from the group consisting of epoxy resin, phenol resin, polycarbonate resin, polyamide-imide resin and polybenzimidazole resin.

5. A magnetic bubble memory device according to claim 1, 2, 3 or 4, wherein said first insulating film is made of one selected from the group consisting of $SiO_2$, $Al_2O_3$, $Si_3O_4$ and said heat-resisting highly-polymerized organic compound.

6. A magnetic bubble memory device according to claim 1, 2, 3 or 4, wherein the sum of respective thicknesses of said first and second insulating films lies within a range from 200 to 1,400 nm.

7. A magnetic bubble memory device according to claim 5, wherein the sum of respective thicknesses of said first and second insulating films lies within a range from 200 to 1,400 nm.

8. A magnetic bubble memory device according to claim 1, 2, 3 or 4, wherein the thickness of said first insulating film lies within a range from 100 to 400 nm.

9. A magnetic bubble memory device according to claim 5, wherein the thickness of said first insulating film lies within a range from 100 to 400 nm.

10. A magnetic bubble memory device according to claim 6, wherein the thickness of said first insulating film lies within a range from 100 to 400 nm.

11. A magnetic bubble memory device according to claim 7, wherein the thickness of said first insulating film lies within a range from 100 to 400 nm.

12. A magnetic bubble memory device according to claim 1, wherein said highly-polymerized compound is a resin that has a viscosity less than 2,000 cps and that forms a hardened film having a dielectric strength of more than $10^5$ V/cm.

* * * * *